US006524493B1

(12) United States Patent
Brusa et al.

(10) Patent No.: US 6,524,493 B1
(45) Date of Patent: Feb. 25, 2003

(54) TEXTILE SIZING COMPOSITION AND TEXTILES SIZED THEREWITH

(75) Inventors: Fabio Ambrogio Brusa, Taino-VA (IT); Roberto Ferrazzi, Gallarate-VA (IT); Giuseppe Li Bassi, Gavirate-VA (IT)

(73) Assignee: Lamberti USA, Inc., Hungerford, TX (US)

( * ) Notice: Subject to any disclaimer, the term of this patent is extended or adjusted under 35 U.S.C. 154(b) by 0 days.

(21) Appl. No.: 09/839,815

(22) Filed: Apr. 20, 2001

(51) Int. Cl.[7] ..... D06B 3/04; D06M 13/165

(52) U.S. Cl. ..... 252/8.83; 8/115.6; 8/147; 8/151.2; 28/217; 106/172.1; 106/178.1

(58) Field of Search ..... 252/8.83; 106/172.1, 106/178.1; 28/217; 8/115.6, 147, 151.2

(56) References Cited

U.S. PATENT DOCUMENTS

| | | | | | |
|---|---|---|---|---|---|
| 4,859,509 | A | * | 8/1989 | Hasuly et al. | 106/207.5 |
| 6,093,217 | A | * | 7/2000 | Frolich et al. | 106/170.4 |
| 6,123,996 | A | * | 9/2000 | Larsson et al. | 427/361 |

FOREIGN PATENT DOCUMENTS

| | | | |
|---|---|---|---|
| GB | 1045197 | * | 10/1966 |
| JP | 58-197383 | * | 11/1983 |
| WO | 00/39398 | * | 7/2000 |

OTHER PUBLICATIONS

Jerry P. Moreau; *Strengthening OE Yarns With Size*, America's Textiles, vol. 12, No. 5, 1983, pp. 22 and 48. (No month).

Jerry P. Moreau; *Comparison of Sized Open–End and Ring Spun Yarns*, Journal of Coated Fabrics, vol. 13, Jul. 1983, pp. 12–22.

Textil–Praxis Int., *For the praxis—from research*, vol. 45, No. 8, 1990, pp. VII–IX. (No month).

*Slashing open end yarn*, America's Textiles R/B Edition, Jun. 1981, pp. 39–40.

Roy L. Whistler et al.; *Polysaccharides and Their Derivatives*, Industrial Gums, Third Edition, 1993, p. 563. (No month).

Cornelis G. Van Ginkel et al.; *The Biodegradability and Nontoxicity of Carboxymethyl Cellulose (DS 0.7) and Intermediates*, Environmental Toxicology and Chemistry, vol. 15, No. 3, 1996, pp. 270–274. (No month).

George D. Robinson; *Sizing and Spun Yarns Ring Spun, Open End, and Air Jet Spun*, Auburn University Textile Slashing Short Course Proe., Sep. 2–3, 1998, pp. 1–24, Slide 1–40.

* cited by examiner

*Primary Examiner*—Anthony J. Green
(74) *Attorney, Agent, or Firm*—Madan, Mossman & Sriram, P.C.

(57) ABSTRACT

The sizing of open-end yarn is disclosed. The sizing of the open-end yarns is performed using a low concentration sizing liquor including from about 20 to 100 percent by weight of high viscosity cellulose ethers.

13 Claims, No Drawings

TEXTILE SIZING COMPOSITION AND TEXTILES SIZED THEREWITH

BACKGROUND OF THE INVENTION

1. Field of the Invention

This invention relates to textile sizing compositions and textiles sized therewith.

2. Background of the Art

Sizing is the term for the procedure wherein yarn is prepared for weaving. During sizing, yarn is coated with a layer of polymers by immersing the yarn in an aqueous sizing liquor in order to diminish friction between the yarn and the metal parts of a loom used to weave the yarn into textiles. Sizing also can improve the abrasion resistance of yarn during weaving.

The main objective of sizing is to allow the weaving of yarns to be done efficiently, reducing the number of breaks and, as a consequence, the number of loom stops. Sized yarns are reinforced, smoothed and lubricated.

A sizing machine (slasher), is a machine having one or two sizing boxes in which yarn, coming from a warping beam or a creel, is immersed in an aqueous sizing solution (sizing bath or sizing liquor). The yarn is then squeezed, in a dryer, using several hot cylinders to eliminate the excess liquor. The dryer also includes a winding unit where the sized yarn is wound onto a beam for eventual loading on a loom to be woven into a textile. Sizing can be performed with a "back beam" system in which several beams are sized at the same time, or with a "beam to beam" system wherein a single beam is sized.

Sizing compositions generally should be easily dispersible in water without foam formation and should produce a sizing liquor having a desired viscosity. Once dried, sizing compositions should form a thin and soluble film on yarn, which is easily removed by washing or scouring from the textile (fabric). One problem with conventional sizing compositions is that they must be removed from the sized fabric to enable an efficient finishing, and thus a large quantity of waste compositions with a high content of pollutants can be discharged into the preparation mills' water, which can result in significant costs for water treatment.

Starch derivatives are widely used in yarn sizing and they are often the main constituent of many sizing compositions. The starch derivatives are usually used together with synthetic polymers such as polyvinyl alcohol and/or with modified natural polymers such as carboxymethyl cellulose, especially where a high film strength is required. One disadvantage of starch derivative sizing compositions is that they may require enzymes for efficient removal, which can increase costs associated with their use. It would be desirable in the art of sizing textile to reduce the "add-on" (quantity of sizing on the yarn), the production costs and also the pollution in waste water resulting from sizing operations.

SUMMARY OF THE INVENTION

In one aspect, the present invention is a sizing composition for use with open-end yarn comprising from about 20 to about 100 percent, by weight, high viscosity cellulose ethers having a molar substitution of from about 0.5 to about 4.0.

In another aspect, the present invention is a sizing liquor for use with open-end yarn comprising from 0.5 to 5 percent by weight of high viscosity cellulose ethers having a molar substitution of from about 0.5 to about 4.0 and having a viscosity of from about 100 to about 1000 cps at 85° C.

In yet another aspect, the present invention is a sized open-end yarn comprising an open-end yard sized with a sizing liquor comprising from 0.5 to 5 percent by weight of high viscosity cellulose ethers having a molar substitution of from about 0.5 to about 4.0 and having a viscosity of from about 100 to about 1000 cps at 85° C. and having an add-on of between about 0.8 and about 6 percent by weight.

Another aspect of the present invention is a process for sizing open-end yarn comprising sizing an open-end yarn using a sizing liquor comprising from 0.5 to 5 percent by weight of high viscosity cellulose ethers having a molar substitution of from about 0.5 to about 4.0 and having a viscosity of from about 100 to about 1000 cps at 85° C.

In still another aspect, the present invention is a sizing composition for use with open-end yarn comprising from about 20 to about 100 percent, by weight, high viscosity cellulose ethers having a molar substitution of from about 0.5 to about 4.0.

DESCRIPTION OF PREFERRED EMBODIMENTS

While all kinds of yarn can be sized, the present invention is directed particularly to the warp sizing of natural, artificial, synthetic or blended staple fibers coming from an open-end spinning, the so called "open-end yarns". Open-end yarns (or rotor yarns) are generated by a non-conventional spinning system in which the sliver feedstock is highly drafted, ideally to individual fiber state, thus creating an open end or a break in the fiber flow. The fibers are subsequently assembled on the end of a rotating yarn and twisted in.

The resulting yarn appears regular and well built, but the longer fibers may twist around the yarn and impart to the yarn its characteristic hairy aspect. The open-end spinning is an alternative to the traditional ring spinning wherein the yarn is produced through the steps of drawing, twisting and winding in a continuous way. The open-end yarn compared to the traditional (or ring yarn) has different tensile characteristics, particularly a lower breaking point, a lower tenacity, a higher stiffness, and a better abrasion resistance.

The viscosity range of sizing liquors of the present invention is usually 50–250 centipoises (cps) at an operating temperature of from about 70 to about 90° C. For the purposes of the present invention, the term "viscosity" means a Brookfield viscosity, determined according to ASTM standard method D2169–99.

The quantity in weight of dried sizing composition applied on 100 part in weight of yarn (add-on) is normally comprised between 6 and 30 percent, depending on the yarn count (fineness). When performing an open-end yarn sizing operation, it is important to consider that this type of yarn is more open, more porous, more bulky, hairy and with a lower tenacity than a traditional ring yarn.

The open-end yarn sizing composition of the present invention essentially consists of from about 20 to about 100 percent by weight of high viscosity cellulose ethers having a M.S. from about 0.5 to about 4.0. For purposes of the present invention, "high viscosity cellulose ethers" are cellulose ethers having a viscosity from 500 to 8000 cps at 20° C. in a 2 percent aqueous solution. The term "M.S." means "molar substitution", namely the average number of moles of substituent added per sugar unit. The preferred high viscosity cellulose ethers of the present invention have a M.S. from about 0.5 to about 1.2.

Advantageously, the high viscosity cellulose ethers of the present invention are selected from the group consisting of carboxymethyl cellulose, hydroxyethyl cellulose, methyl cellulose, and mixtures thereof. Particularly preferred among these cellulose ethers is carboxymethyl cellulose. The preferred high viscosity cellulose ethers of the present invention have a viscosity from 1000 to 3000 cps at 20° C. in a 2 percent aqueous solution. When the cellulose ethers are carboxymethyl cellulose or methyl cellulose the M.S. value coincides with the D.S. value; the term "D.S." means "degree of substitution", namely the average number of hydroxyl groups per monosaccharide unit that have been etherified.

According to one aspect of the present invention, the open-end yarn sizing composition may contain one or more natural, natural-modified, or synthetic polymers chosen in the group consisting of polyvinyl alcohol, acrylic polymers and copolymers, starch, modified starch, polygalactomannans, tamarinds. According to a further feature of the present invention, the sizing compositions are normally dispersed or solubilised in water to prepare sizing liquors for open-end yarns; these liquors have a viscosity from 100 to 1000 cps at 85° C., preferably from 100 to 300 cps, and essentially contain from 0.5 to 5 percent by weight of high viscosity cellulose ethers having a M.S. from about 0.5 to about 4.0.

According to another aspect of the present invention, the open-end yarns sized with the sizing compositions of this invention have an add-on of from about 0.8 to about 6 percent by weight. The results obtained with the sizing compositions of this invention are desirably advantageous compared with the prior art requirement of loading yarns with from 6 to 30 percent by weight of add-on. As already stated, all sizing compositions applied on yarn should be removed from the fabric before dyeing and finishing.

The sizing compositions normally contribute about 70 percent of the pollution of wastewater from a preparation mill. It is well known that all wastewater must be treated in order to reach a Chemical Oxidation Demand (COD) and a Biological Oxidation Demand (BOD) within the limits of law and a drastic reduction of oxygen request during wastewater treatment is economically very advantageous. Using the sizing compositions of the present invention, the add-on can be reduced by from 60 to 80 percent and a COD reduction of 70 percent can thus be expected. This is an excellent result both from a technological and from an economic point of view.

The sizing compositions of the present invention can also be sold as aqueous solutions or dispersions. In the examples, all parts are by weight and the viscosities are at 20° C., if not otherwise reported.

EXAMPLE 1

Preparation of the Sizing Liquors

A 2% water solution of purified (>98%) carboxymethyl cellulose having a viscosity of 2500 cps at 2% and D.S. of 0.7 (Size A) is prepared (Liquor A). The Liquor A has a viscosity of 200 cps at 85° C.

A 10% water solution of a sizing composition (Size B) consisting of a 4:1 mixture of hydroxyethyl starch (M.S. 0.08 and viscosity of 80 cps at 10% and 85° C.) and partially hydrolyzed polyvinyl alcohol (viscosity of 25 cps at 4%) is prepared (Liquor B). The Liquor B has a viscosity of 100 cps at 85° C.

A 2% water solution of a sizing composition (Size C) consisting of 70% of purified (>98%) carboxymethyl cellulose having a viscosity of 2500 cps at 2% and D.S. of 0.7, 20% of partially hydrolyzed polyvinyl alcohol (viscosity of 50 cps at 1%) and of 10% of guar (viscosity of 3000 cps at 1%) is prepared (Liquor C). The Liquor C has a viscosity of 200 cps at 85° C.

A 2% water solution of low viscosity purified (>98%) carboxymethyl cellulose having a viscosity of 50 cps at 2% and a D.S. of 0,7 (Size D) is prepared (Liquor D). The Liquor D has a viscosity of 5 cps at 85° C.

A 7% water solution of Size D is prepared (Liquor E). The Liquor E has a viscosity of 200 cps at 85° C.

The Liquor A and the Liquor B are used to size two grey open-end cotton yarns with the following characteristics:

| | |
|---|---|
| FIBER: | OE GREY COTTON |
| COUNT: | Nm 34 (Ne 20) |
| N° ENDS: | 4350 |
| WIDTH: | 180 cm |
| YARN DENSITY: | 24 ends/cm |
| WEFT: | Cotton OE Nm 34 |
| CONSTRUCTION: | Plane Weave |

The percentage of sizing liquor on the yarn (pick-up) and the percentage of dried sizing composition on the yarn (add-on) are measured by weighing. The breaking point and elongation of un-sized and sized yarns are measured according to ASTM D3822–96. The results are expressed as improvement of breaking point and as improvement in elongation in respect with an untreated yarn. The resistance to abrasion of the sized yarns is measured using a ZWEIGLE G 550 abrasion tester on which 20 fixed threads are submitted to abrasion of an oscillating abrasive paper covered cylinder that stresses the yarn until the breakage point or until pilling is formed. The results are expressed as improvement of resistance to abrasion in respect with an untreated yarn. An improvement of resistance to abrasion of the sized yarn higher than 60% is considered a good result on cotton.

The tensile characteristics of the yarns sized respectively with the Liquor A and with the Liquor B (Sized Yarn A1 and Sized Yarn B1) are displayed in Table 1.

TABLE 1

| Tensile characteristic of the Sized yarn 100% cotton | Sized Yarn A1 | Sized Yarn B1 |
|---|---|---|
| PICK-UP % | 160 | 140 |
| ADD-ON % | 3.2 | 12.6 |
| IMPROVEMENT OF RESISTANCE TO ABRASION % | +130 | +126 |
| IMPROVEMENT OF BREAKING POINT % | +56 | +56 |
| IMPROVEMENT OF ELONGATION % | −19 | −27 |

In Table 2. are summarized the COD data relative to the waste water obtained from the de-sized fabrics obtained respectively from Sized Yarn A1 and Sized Yarn B1 (Fabric Al and Fabric B1)

The calculation is based on the following COD values:

COD Liquor A1=0,902 Kg/Kg

COD Liquor B1=1,173 Kg/Kg

TABLE 2

| | Fabric A1 | Fabric B1 |
|---|---|---|
| Kg of sizing for 100 Kg of fabric | 1.6 | 6.3 |
| Kg of oxygen demand to degrade the waste water relative to 100 Kg of fabric | 1.44 | 7.39 |

The oxygen saving with the Fabric A1 is 80% with respect to the Fabric B1.

EXAMPLE 2

The Liquor A, the Liquor B and the Liquor C, prepared as in Example 1., are used to size a grey open-end cotton/polyester (67/33) yarn with the following characteristics:

| | |
|---|---|
| FIBER: | Cotton/Polyester (67/33) |
| COUNT: | Nm 34 (Ne 20) |
| N° ENDS: | 4350 |
| WIDTH: | 180 cm |
| YARN DENSITY: | 24 ends/cm |
| WEFT: | Cotton OE Nm 34 |
| CONSTRUCTION: | Plane Weave |

The characteristics of the yarns respectively sized with the Liquor A, the Liquor B and the Liquor C (Sized Yarn A2, and Sized Yarn B2 and Sized Yarn C2) are measured as in Example 1.

The results are displayed in Table 3.

TABLE 3

| Tensile characteristic of the sized yarn Cotton/polyester - 67/33 | Sized Yarn A2 | Sized Yarn C2 | Sized Yarn B2 |
|---|---|---|---|
| PICK-UP % | 150 | 160 | 130 |
| ADD-ON % | 3.3 | 3.2 | 13.0 |
| IMPROVEMENT OF RESISTANCE TO ABRASION % | +105 | +120 | +105 |
| IMPROVEMENT OF BREAKING POINT % | +37 | +42 | +41 |
| IMPROVEMENT OF ELONGATION % | −18 | −19 | −27 |

EXAMPLE 3

The Liquor A, the Liquor D and the Liquor E, prepared as in Example 1., are used to size a grey open-end cotton yarn with the following characteristics:

| | |
|---|---|
| FIBER: | GREY OE COTTON |
| COUNT: | Nm 34 (Ne 20) |
| N° ENDS: | 4350 |
| WIDTH: | 180 cm |
| ENDS DENSITY: | 24 ends/cm |
| WEFT: | Cotton OE Nm 34 |
| CONSTRUCTION: | Plane Weave |

The characteristics of the yarns respectively sized with the Liquor A, the Liquor D and the Liquor E (Sized Yarn A1, D1, E1) are measured as in Example 1.

The results are displayed in Table 4.

TABLE 4

| Tensile characteristic of the sized yarn 100% cotton | Size Yarn A1 | Sized Yarn D1 | Size Yarn E1 |
|---|---|---|---|
| PICK-UP % | 160 | 100 | 140 |
| ADD-ON % | 3.2 | 2.0 | 9.8 |
| IMPROVEMENT OF RESISTANCE TO ABRASION % | +130 | +10 | +123 |
| IMPROVEMENT OF BREAKING POINT % | +56 | +15 | +55 |
| IMPROVEMENT OF ELONGATION % | −19 | −10 | −27 |

EXAMPLE 4

The Liquor A, prepared as in Example 1., is used to size a grey open-end cotton yarn and to size a ring yarn. The yarns have the following characteristics:

| | |
|---|---|
| FIBER: | COTTON |
| COUNT: | Nm 34 (Ne 20) |
| N° ENDS: | 4350 |
| WIDTH: | 180 cm |
| ENDS DENSITY: | 24 ends/cm |
| WEFT: | Cotton OE Nm 34 |
| CONSTRUCTION: | Plane Weave |

The characteristics of the yarns (Sized OE Yarn A1 and Sized Ring Yarn A) are measured as in Example 1.

The results are displayed in Table 5.

TABLE 5

| Tensile characteristic of the Sized yarn 100% cotton | Sized OE Yarn A1 | Sized Ring Yarn A |
|---|---|---|
| PICK-UP % | 150 | 100 |
| ADD-ON % | 3.2 | 2.0 |
| IMPROVEMENT OF RESISTANCE TO ABRASION % | +130 | +53 |
| IMPROVEMENT OF BREAKING POINT % | +37 | +10 |
| IMPROVEMENT OF ELONGATION % | −18 | −15 |

What is claimed is:

1. A sizing composition for use with open-end yarn comprising from about 20 to about 100 percent, by weight, high viscosity cellulose ethers having a molar substitution of from about 0.5 to about 4.0 and a viscosity of from 500 to 8000 cps in at 20° C. in a 2 percent aqueous solution.

2. The sizing composition of claim 1 wherein the high viscosity cellulose ethers have a molar substitution of from about 0.5 to about 1.2.

3. The sizing composition of claim 1 wherein the sizing composition includes from about 30 to about 100 percent by weight high viscosity cellulose ethers.

4. The sizing composition of claim 1 wherein the high viscosity cellulose ethers are selected from the group consisting of carboxymethyl cellulose, hydroxyethyl cellulose and methyl cellulose, and mixtures thereof.

5. The sizing composition of claim 1 wherein the high viscosity cellulose ethers have a viscosity of from 1000 to 3000 cps at 20° C. in a 2% aqueous solution.

6. The sizing composition of claim 1 wherein the composition additionally includes one or more natural, natural-modified, or synthetic polymers selected from the group consisting of polyvinyl alcohols, acrylic polymers and copolymers, starches, modified starches, polygalactomannans, tamarinds, and mixtures thereof.

7. A sizing liquor for use with open-end yarn comprising from 0.5 to 5 percent by weight of high viscosity cellulose ethers having a molar substitution of from about 0.5 to about 4.0 and having a viscosity of from about 100 to about 1000 cps at 85° C. wherein the high viscosity cellulose ethers are selected from the group consisting of carboxymethyl cellulose, hydroxyethyl cellulose, methyl cellulose, and mixtures thereof.

8. The sizing liquor of claim 7 wherein the high viscosity cellulose ethers have a molar substitution of from about 0.5 to about 1.2.

9. The sizing liquor of claim 7 having a viscosity of from about 100 to about 300 cps at 85° C.

10. A sized open-end yarn comprising an open-end yard sized with a sizing liquor of claim 7 having an add-on of between about 0.8 and about 6 percent by weight.

11. A process for sizing open-end yam comprising sizing an open-end yarn by applying a sizing liquor of claim 7 to the open end yarn.

12. The process of claim 11 wherein the sizing liquor has a viscosity of from about 100 to about 300 cps at 85° C.

13. A sizing composition for use with open-end yarn comprising from about 20 to about 100 percent, by weight, high viscosity cellulose ethers having a molar substitution of from about 0.5 to about 1.2 and wherein the high viscosity cellulose ethers have a viscosity of from 1000 to 3000 cps at 20° C. in a 2% aqueous solution.

* * * * *